United States Patent [19]

Grignon et al.

[11] Patent Number: 5,029,898

[45] Date of Patent: Jul. 9, 1991

[54] SKI POLE AND GUARD

[76] Inventors: Charles E. Grignon, 36 Bailey Dr., Washington Crossing, Pa. 18977; John C. Dooley, Jr., 29 Mobile Ave., Staten Island, N.Y. 10306; Richard Pikulski, 45 Neil Rd., Vernon, Conn. 06066

[21] Appl. No.: 453,411

[22] Filed: Dec. 19, 1989

[51] Int. Cl.[5] ..... A63C 11/00

[52] U.S. Cl. ..... 280/821; 2/17

[58] Field of Search ..... 280/821, 819; 74/551.8, 74/551.9; 2/17, 164, 272; 296/78.1

[56] References Cited

U.S. PATENT DOCUMENTS

| | | | |
|---|---|---|---|
| 568,024 | 9/1896 | Gorman | 74/543 |
| 3,746,356 | 7/1973 | Shipstad | 280/821 |
| 3,832,912 | 9/1974 | Edwards | 74/551.8 |
| 3,874,686 | 4/1975 | Shipstad et al. | 280/821 |
| 4,343,490 | 8/1982 | Adamson | 280/821 |
| 4,572,545 | 2/1986 | Dooley, Jr. et al. | 280/821 |
| 4,657,282 | 4/1987 | Roch | 280/821 |

FOREIGN PATENT DOCUMENTS

| | | | |
|---|---|---|---|
| 2357662 | 5/1975 | Fed. Rep. of Germany | 280/821 |

*Primary Examiner*—Andres Kashnikow
*Assistant Examiner*—Richard Camby
*Attorney, Agent, or Firm*—Collard, Roe & Galgano, P.C.

[57] ABSTRACT

A ski pole hand guard is intended to be mounted on a ski pole directly below the hand grip. This hand guard includes a pole attachment member and a cup-shaped, almost semi-circular guard member which surrounds the hand grip in an arc of less than 180° and projects outwardly slightly beyond the normal distance needed to clear a skier's ski glove. A top flange member extends from the top edge of the guard member inwardly towards the center line of the ski pole. The hand guard structure is constructed of durable, impact resistant material and is rigidly attached to the pole attachement member. When in use, the skier grasps the ski pole hand grip as normal and has the first joint of his thumb and the first, second and third joints of his fingers within the bounds of the guard member and flange memner. The hand guard sufficiently surrounds a skier's hand to retain it during the initial fall reflex and protect it from the impact of the initial contact made during a normal fall. It is sufficiently small to reduce the possibility of wrist injury and to allow easy hand release.

5 Claims, 1 Drawing Sheet

SKI POLE AND GUARD

BACKGROUND OF THE INVENTION

1. Field of the Invention:

This invention relates to sports protective equipment and specifically relates to hand shields and hand guards for use on ski poles and the like.

2. Description of the Prior Art

Protective hand shields have been the subject matter of certain sports equipment for some time. As an example, U.S. Pat. No. 3,832,912, to Edwards, shows a handlebar safety shield for a motorcycle. This safety shield is a c-shaped bar which is clamped to the motorcycle handlebar. U.S. Pat. No. 568,024 to Gorman, shows a shield for bicycle handles. This shield is a cylindrical cup-shaped metal guard which is open at one end and is partially open at the other end. This guard is clamped to the handlebar of a bicycle in front of the handlebar grip. Gorman, has designed his shield to extend in a semi-circular arc of at least 180°; and it is mounted to the center line axis of the handlebar grip.

Hand guards or hand shields have been developed for ski poles over the past few years. These hand guards were first intended to protect the skier in a fall. What occurs when a skier falls on his ski pole can vary depending upon how the fall occurs. In one instance, the impact is taken by the fingers or knuckles of the skier. In a second instance, the impact is absorbed by the pole being jammed against the second joint of the thumb. In a third instance, the skier's hand opens and the thumb or any number of fingers are impacted on their ends. All of the above situations and others create a likelihood for a severe sprain in one or more joints of the hand. Abrasions and contusions are also quite likely.

German Patent DE 23 57 662 to Chiba and U.S. Pat. No. 3,746,356 and 3,874,686 to Shipstad and U.S. Pat. No. 4,343,490 to Adamson, all show ski pole hand enclosures which are intended to act as a shield. In each of these, the enclosure completely surrounds the hand and goes around the ski pole in an arc of greater than 180°. These shields enclose the hand and keep it from opening, thereby counteracting the reflex action in an initial fall impact and reducing the likelihood of certain types of finger sprains. However, they completely enclose the hand so that under certain instances, the shield itself impacts upon the wrist.

Moreover, some of these hand shields incorporate a ski pole grip as an integral formed part thereof. This produces a disadvantage in that the type of material, usually plastic, for constructing a ski pole grip, should be different from that used for a hand guard. The hand guard material should be of rigid, reasonably unflexible and resilient material, such as certain types of plastics, fiberglass and metals. The ski pole hand grip itself should be of soft and pliable plastic. It is difficult to create a one piece combination hand guard and grip, as ideally, they should be of dissimiliar materials.

U.S. Pat. No. 4,572,545 to Dooley et al discloses a ski pole hand shield which does not incorporate, as a part thereof, the ski pole grip. This allows the Dooley hand shield to be constructed of material which is rigid and resilient. Dooley, however, has designed his hand shield to extend around the ski pole in an arc of approximately 205°, as shown in FIG. 4 of his patent. This arc allows the hand shield to impact upon the wrist of the skier if the shield twists during a fall.

SUMMARY OF THE INVENTION

It is an object of the invention to provide a hand guard for a ski pole which can be installed on the pole while using the existing ski pole and grip.

It is a further object of the invention to provide a hand guard which is sufficiently large to protect the thumb and fingers of the skier during initial impact; to restrain the opening of the hand during the initial reflex action of a fall; but is sufficiently small to allow the hand to be easily withdrawn from the guard and to minimize or eliminate any sprain or contusions that might occur from a guard striking the wrist of the skier.

It is yet an additional object of the invention to provide a hand guard for a ski pole which is simple in design, easy to manufacture and capable of being placed on a wide variety of ski poles.

Accordingly, these and related objects are achieved by a ski pole hand shield constructed as a single piece continuous structure. The hand shield includes a pole attachment sleeve member which is intended to be mounted over a ski pole below the ski pole hand grip. Also included is a hand guard or shield member which is attached to the pole attachment sleeve member and extends outwardly and upwardly from the pole attachment member and about the front or finger engagement section of the ski pole hand grip.

The hand guard member, while having a semi-circular cup shape, extends in an arc less than 180° so that the back edges of the cup do not go by the center line of the hand grip. These edges, which rise vertically, are in front of the center line of the ski pole. An inwardly projecting flange or lip member extends essentially horizontally from the top edge of the cup. This flange member, as well as the cup, have rounded edges which break away to allow insertion of a skier's hand into the guard and about the ski pole grip.

The pole attachment sleeve member is essentially cylindrical with an outwardly tapered top end. This attachment member carries a central longitudinal bore of approximately the size and shape of the ski pole upon which the structure is to be installed. The top end of the pole attachment sleeve member which abuts the cup tapers outwardly to form the cup interface. The cup interface end of this pole attachment sleeve has a concave surface. The opposite end has a flanged portion extending inwardly normal to the longitudinal axis of the pole attachment sleeve and covers the head. In another embodiment, the hand guard member is integrally formed with the pole, and extends along the length of the pole in a smooth taper.

The structure can be made as a single piece injection molded structure of polyethylene or polypropolene or other types of synthetic resin material. This thermoplastic resin material would normally soften between 200° F. and 300° F. The guard could be inserted on a ski pole by softening the pole attachment sleeve member and then pressing this sleeve member onto the ski pole while in the softened state. Likewise, a glue or other chemical adhesive could be used to hold the pole attachment sleeve onto a ski pole.

As an alternative to the thermoplastic resin, the guard structure can be constructed of any of a number of synthetic materials including fiberglass, as well as various metals which are sufficiently durable and resilient, as well as being light in weight.

These and other objects and advantages of the present invention will become apparent from the following description of the accompanying drawings, which disclose several embodiments of the invention. It is to be understood that the drawings are to be used for the purpose of illustration only, and not as a definition of the invention.

BRIEF DESCRIPTION OF THE DRAWINGS

The advantages, structure and features of the present invention will be readily understood from a reading of the description of the preferred embodiments in conjunction with accompanying drawings in which like numerals refer to like elements and in which.

DETAILED DESCRIPTION OF THE PREFERRED EMBODIMENTS

Referring to FIGS. 1–5, there is shown a first embodiment of the invention consisting of a one-piece hand guard for a ski pole, generally designated as 10. The center of hand guard 10 is provided with an opening 11 in order to receive the shaft of a normal ski pole. The wall portion 14 of the hand guard extends upwardly and over the hand slightly, as shown, inwardly extending flange by 13 so as to partially cover the thumb and index finger while the ski pole is in use. Initially formed as part of the guard is shank 12, which is extended a sufficient distance along the length of the pole to properly grip the pole after the guard has been inserted on the pole's shaft. The hand guard of the present invention is shown as semi-circular and cupshaped, and it extends in an arc of less than 180° so that the back edges of the cup do not extend past the center line of the hand grip.

The one piece hand guard for a ski pole is constructed of rigid resilient material and is of a weight which will not destroy the balance of the ski pole. This hand guard is of sufficient size to restrain the hand during the initial impact of a fall but will allow for easy release during the second bounce normally incurred in a fall.

Figure 5:
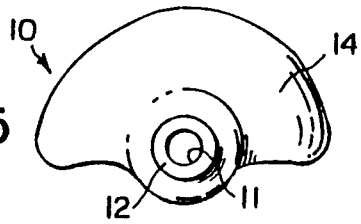
FIG. 5 shows a bottom view of the guard.
Figure 4:
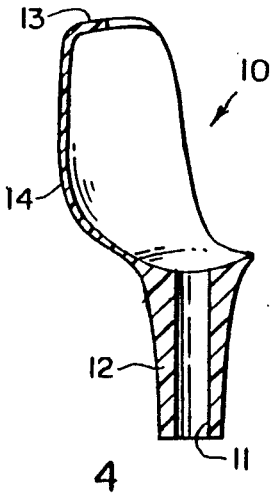
FIG. 4 shows a cross-sectional view of the guard as taken as shown in FIG. 2.
Figure 3:
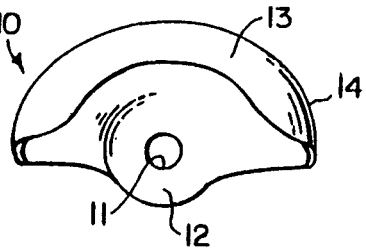
FIG. 3 shows a top view of the guard of FIG. 1.
Figure 1:
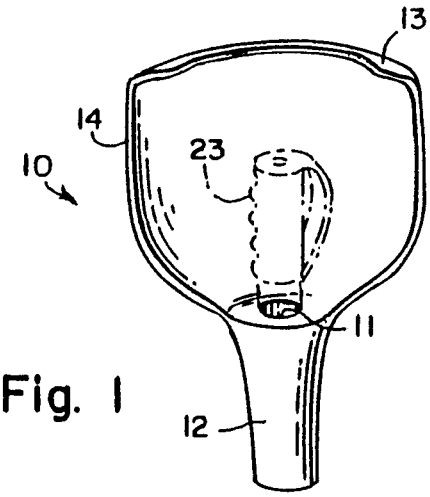
FIG. 1 shows a back view of the hand guard.
Figure 2:
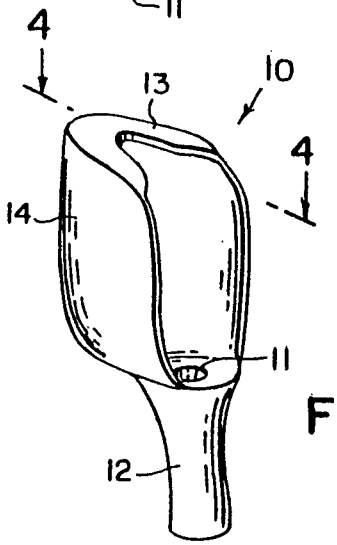
FIG. 2 shows a side view of the guard of FIG. 1 rotated approximately 80° from its position of FIG. 1.
Figure 6:
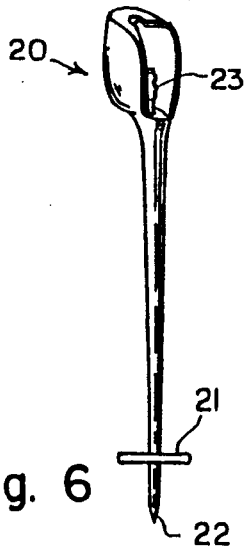
FIG. 6 shows a second embodiment of the invention wherein the hand guard is integrally formed with the pole in a smooth transition along the length of the pole.
Figure 7:
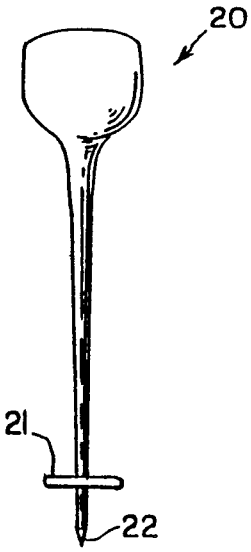
FIG. 7 is a back view of the guard of FIG. 6.
Figure 8:
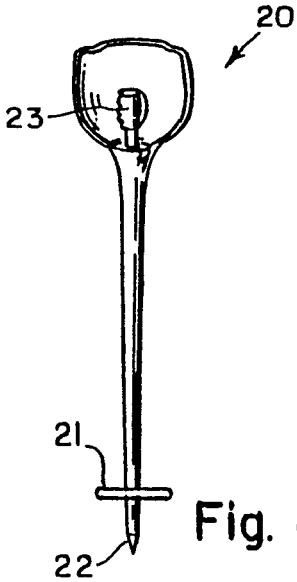
FIG. 8 is a front view of the guard of FIG. 6.

Referring to FIGS. 6, 7 and 8, there is shown a second embodiment of the present invention wherein the hand guard, generally designated as 20, completely covers the shaft of the pole and terminates the hand grip portion in a cup-shaped enclosure similar to the embodiment of FIGS. 1–5. The usual basket 21 is then inserted on to the end of the combination pole and guard, and the tip of the pole 22 extends below the basket as shown. In this embodiment, hand guard 20 is molded completely around the shaft of the pole and its hand guard 23 so that there is no shoulder or sharp transition between the hand guard and the pole. The one-piece hand guard preferably extends down below the basket 21 to adjacent to the tip of the pole so that the exposed solid tipped 22 can project through the bottom opening of the one-piece guard.

While several embodiments and examples of the present invention have been illustrated and described it is obvious that many changes and modifications may be made thereunto, without department from the spirit and scope of the invention.

What is claimed is:

1. A ski pole hand shield for use with a ski pole having a shaft defining an axis, comprising:

a main body having a lower mounting part securable to the ski pole shaft below a gripping portion thereon, wherein said lower mounting part extends downwardly along said shaft below a basket adjacent a tip of the pole, and an inwardly open and axially upwardly U-section guard part flaring upwardly and radially outwardly from the mounting part, the guard surrounding the gripping portion at a spacing sufficient for a hand to engage the gripping portion within the guard part, said guard part being formed with an inwardly extending flange along an upper edge thereof, said flange extending inwardly towards the axis defined by the shaft in a direction generally perpendicular thereto to overlie the hand engaging the gripping portion.

2. A ski pole hand shield as set forth claim 1, wherein said upwardly open U-section guard has a semi-circular cross-section.

3. A ski pole hand shield as set forth in claim 2, wherein said semi-circular cross-section extends in an arc around said axis defined by the shaft of less than 180°.

4. A ski pole hand shield as set forth in claim 1, wherein said lower mounting part is molded completely around the ski pole shaft and a lower portion of said gripping portion so that no sharp transition occurs between the shaft and said gripping portion.

5. A ski pole hand shield as set forth in claim 1, wherein said main body is constructed of a rigid resilient plastic material.

* * * * *